US007404496B2

(12) United States Patent
Neil et al.

(10) Patent No.: US 7,404,496 B2
(45) Date of Patent: Jul. 29, 2008

(54) GREEN-STATE CERAMIC DISCHARGE VESSEL PARTS

(75) Inventors: Jeffrey T. Neil, North Reading, MA (US); Gregory Zaslavsky, Marblehead, MA (US); Victor E. Perez, Manchester, NH (US); Joseph V. Lima, Salem, MA (US)

(73) Assignee: Osram Sylvania Inc., Danvers, MA (US)

( * ) Notice: Subject to any disclaimer, the term of this patent is extended or adjusted under 35 U.S.C. 154(b) by 360 days.

(21) Appl. No.: 11/160,334

(22) Filed: Jun. 20, 2005

(65) Prior Publication Data

US 2005/0215167 A1 Sep. 29, 2005

(51) Int. Cl.
*B65D 6/00* (2006.01)
*B65D 25/28* (2006.01)

(52) U.S. Cl. ..... 220/4.21; 220/759

(58) Field of Classification Search ..... 220/4.21, 220/4.24, 4.25, 752, 759; 445/66, 67, 26; 313/634, 571

See application file for complete search history.

(56) References Cited

U.S. PATENT DOCUMENTS

| | | | | |
|---|---|---|---|---|
| 54,852 | A * | 5/1866 | Burnham | 30/164.6 |
| 2,915,200 | A * | 12/1959 | Roeber | 198/403 |
| 4,527,097 | A * | 7/1985 | van der Heijden et al. | 315/246 |
| 4,734,612 | A * | 3/1988 | Sasaki et al. | 313/15 |
| 5,424,609 | A * | 6/1995 | Geven et al. | 313/623 |
| 5,742,124 | A * | 4/1998 | Kees et al. | 313/625 |
| 6,354,901 | B1 * | 3/2002 | Bundo et al. | 445/26 |
| 6,465,940 | B1 * | 10/2002 | Ikeuchi et al. | 313/283 |
| 6,620,272 | B2 | 9/2003 | Zaslasky et al. | 156/73.5 |
| 6,769,947 | B1 * | 8/2004 | Kuenzler et al. | 445/46 |
| 6,800,011 | B2 * | 10/2004 | Watanabe et al. | 445/35 |
| 7,170,228 | B2 * | 1/2007 | Hecker et al. | 313/623 |
| 2002/0117249 | A1 * | 8/2002 | Zaslavsky et al. | 156/89.11 |
| 2002/0117965 | A1 * | 8/2002 | Kotter et al. | 313/573 |

FOREIGN PATENT DOCUMENTS

| | | |
|---|---|---|
| EP | 0 559 421 A1 | 9/1993 |
| EP | 1 111 654 A1 | 6/2001 |
| GB | 2 080 018 A | 1/1982 |

* cited by examiner

*Primary Examiner*—Anthony D Stashick
*Assistant Examiner*—Robert J Hicks
(74) *Attorney, Agent, or Firm*—Robert F. Clark

(57) ABSTRACT

A ceramic discharge vessel in a green state prior to assembly includes a first discharge vessel part in a green state, a second discharge vessel part in a green state, wherein the first and second discharge vessel parts form a discharge vessel when joined together, and a first capillary attached to the first discharge vessel part and a second capillary attached to one of the first and second discharge vessel parts. To facilitate joining the first and second discharge vessel parts, a first removable handle is temporarily attached to the first discharge vessel part for maneuvering the first discharge vessel part, and a second removable handle is temporarily attached to the second discharge vessel part for maneuvering the second discharge vessel part.

14 Claims, 2 Drawing Sheets

GREEN-STATE CERAMIC DISCHARGE VESSEL PARTS

BACKGROUND OF THE INVENTION

The present invention is directed to a ceramic discharge vessel for a high intensity discharge lamp and more particularly to the structure of parts of the discharge vessel that are in a green state during assembly of the discharge vessel.

Commercial ceramic discharge vessels typically include a polycrystalline alumina (PCA) ceramic. Alumina powder is mixed with a binder and the mixture is formed into a desired shape by isostatic pressing, extrusion or injection molding. The binders help a molded alumina part retain its shape while the part is in its "green state" (prior to binder removal and sintering).

U.S. Pat. No. 6,620,272, which is incorporated by reference, describes a method for assembling a ceramic body in which two ceramic halves of a discharge vessel are joined together. The surfaces to be joined are heated to cause localized melting and then brought together and joined at a seam by alternately compressing and stretching the seam. The joining apparatus described in this patent is shown in FIG. 1. The discharge vessel parts 1 are shown secured in the joining apparatus through the use of opposed holders 15. The discharge vessel parts and their corresponding holders are oriented to share common axis 12. Retractable pins 35 engage the electrode-receiving members (capillaries) 3 of the discharge vessel parts to hold the parts in place during joining. Once secured in the apparatus, the relative positions of the two parts are registered so that they may be accurately mated. Heater 19 is then interposed between the two holders and adjacent to the joining surfaces 7 of the discharge vessel parts. After heating, the parts are immediately brought together by displacing one or both of the holders toward each other along common axis 12. Compression is then applied by continuing to displace the parts in a forward direction toward each other and past the initial point of contact. The compression causes the softened material to bulge outward forming a visible seam. As the parts are brought together and compressed, the melted surfaces weld together to form a unitary body. At a predetermined point, the forward displacement of the discharge vessel parts is reversed and the parts are pulled away from each other causing a stretching of the material in the interface region. The stretching causes the still pliable material to thin thereby reducing the prominence of the seam. During stretching, the reverse displacement is preferably continued back through and beyond the initial point of contact between the sections.

This device is suitable for assembly of a discharge vessel from two green-state discharge vessel parts that have capillaries (3 in FIG. 1) on opposite sides that can be grasped by the device (e.g., pins 35) to facilitate the compression and stretching that reduce the prominence of the seam.

However, some discharge vessels parts do not have capillaries on opposite sides of a body and thus the device in FIG. 1 would not be suitable for assembling such discharge vessels. Discharge vessels with two capillaries on the same side of the body are disclosed in EP 1 111 654.

Further, regardless of whether the green-state discharge vessel parts are subject to the compression and stretching of the above-noted U.S. patent, green-state discharge vessel parts that are to be joined together must still be held in a stable and repeatable position to align the discharge vessel parts. The parts may pivot in their respective holders, causing misalignment of the capillaries, which must have a particular location and angle relative to each other in an assembled discharge vessel.

SUMMARY OF THE INVENTION

An object of the present invention is to provide a novel structure for a green-state discharge vessel part that is adaptable to a device that assembles a discharge vessel from two or more green-state parts.

A further object of the present invention is to provide novel discharge vessel parts in a green state prior to final assembly of a ceramic discharge vessel, including first and second discharge vessel parts in a green state that are adapted to be joined to form the discharge vessel, and, to facilitate joining the first and second discharge vessel parts, a first removable handle temporarily and removably attached to the first discharge vessel part for maneuvering the first discharge vessel part and a second removable handle temporarily and removably attached to the second discharge vessel part for maneuvering the second discharge vessel part, the first and second removable handles being separate from capillaries also attached to respective discharge vessel parts.

These and other objects and advantages of the invention will be apparent to those of skill in the art of the present invention after consideration of the following drawings and description of preferred embodiments.

BRIEF DESCRIPTION

DESCRIPTION OF PREFERRED EMBODIMENTS

Figure 1:
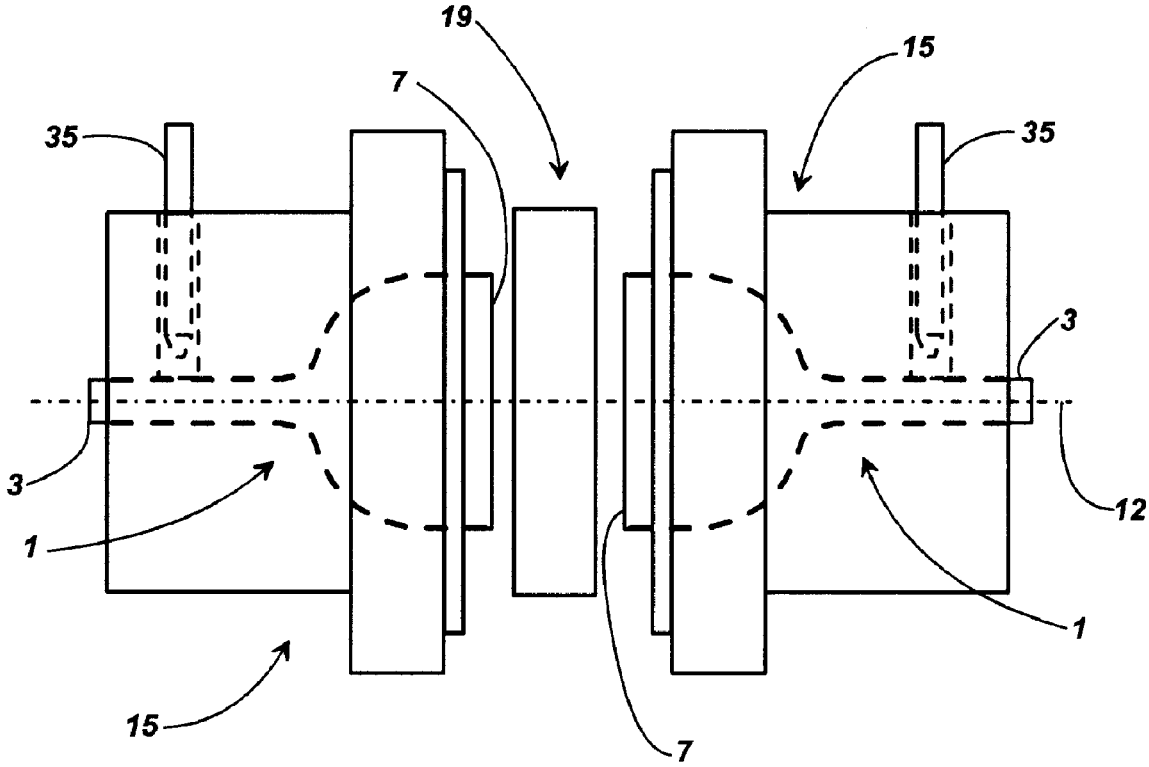
Fig. 1 (Prior Art)
FIG. 1 is a pictorial representation of a device of the prior art that joins together two ceramic parts.
Figure 2:
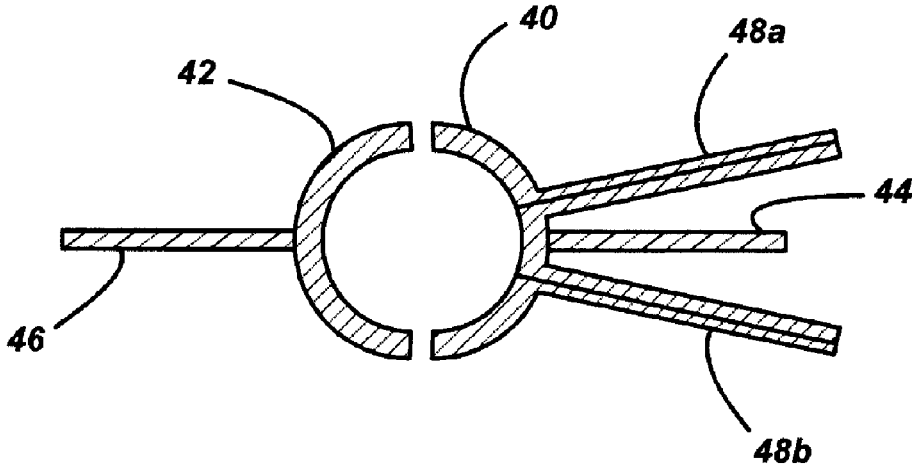
FIG. 2 is a cross section of an embodiment of the present invention.
Figure 3:
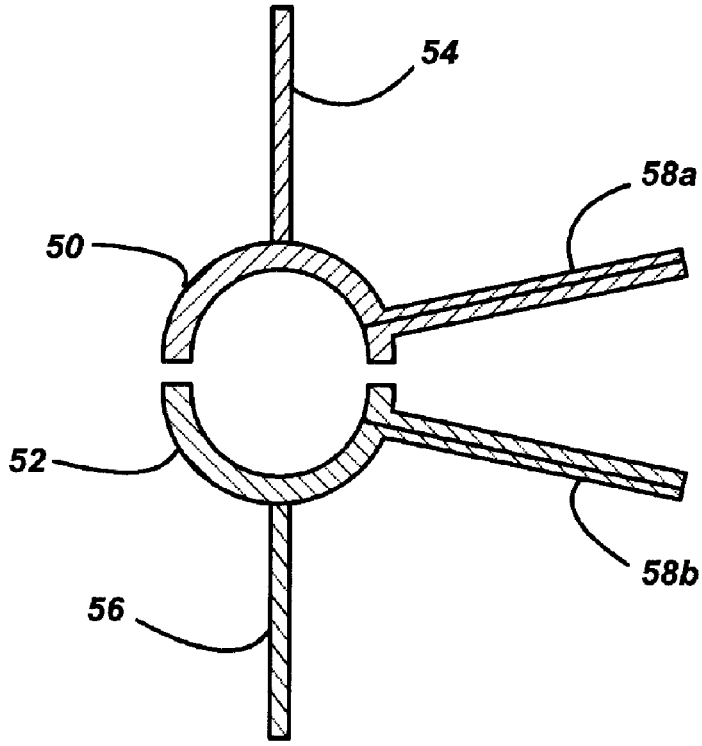
FIG. 3 is a cross section of a further embodiment of the present invention.

With reference now to FIGS. 2 and 3, a ceramic discharge vessel in a green state prior to assembly includes a first discharge vessel part 40, 50 in a green state, a second discharge vessel part 42, 52 in a green state, where the first and second discharge vessel parts are adapted to form a discharge vessel when joined together, and, to facilitate joining together the first and second discharge vessel parts, a first removable handle 44, 54 temporarily attached to the first discharge vessel part 40, 50 for maneuvering the first discharge vessel part and a second removable handle 46, 56 temporarily attached to the second discharge vessel part 42, 52 for maneuvering the second discharge vessel part. The first and second removable handles are used to position the first and second discharge vessel parts in a device that joins the two parts together to form a discharge vessel, such as the device shown in FIG. 1 or other similar devices.

The removable handles are removed at a suitable time after the two parts have been joined together, e.g., after binder removal or final sintering. Preferably, the removal site does not present a blemish of sufficient size to affect light transmission from the discharge vessel.

Desirably, the first and second removable handles 44, 46; 54, 56 are substantially collinear when the first and second discharge vessel parts are joined together to facilitate alignment of the discharge vessel parts. The first and second removable handles are preferably solid shafts for increased strength, and may be tapered to facilitate removal from a mold. They may be made of the same ceramic material as the discharge vessel parts and/or capillaries or other suitable material that is temporarily and removably attachable to the discharge vessel parts.

The first discharge vessel part 40, 50 includes a first hollow capillary 48*a*, 58*a* attached to the first discharge vessel part. A second hollow capillary 48*b*, 58*b* is attached to one of the first and second discharge vessel parts. The capillaries are adapted to receive electrodes for the lamp. The capillaries are permanently affixed to the respective discharge vessel parts, as distinguished from the removable handles that are only temporarily attached to the discharge vessel parts. The longitudinal axes of the two capillaries may be collinear, may diverge from each other, or may be parallel to each other, depending on the type of discharge vessel being made.

The first and second discharge vessel parts may be generally hemispheric as shown in the drawings or may have other shapes (e.g., elliptical or cylindrical) suitable for the type of discharge vessel being made. When the discharge vessel parts are hemispheric, preferably the first and second removable handles are temporarily attached at respective poles (e.g., north and south poles) of these hemispheric discharge vessel parts to facilitate proper alignment of the parts.

FIGS. 2 and 3 show two embodiments of the discharge vessel parts of the present invention. FIG. 2 includes two different discharge vessel parts (one part has two capillaries or places where the two capillaries are attached and one part has none) and therefore would require two different molds to form the two different parts. FIG. 3 includes two discharge vessel parts that are identical (each part has or is adapted to receive one capillary) and therefore this embodiment offers the advantage of using the same mold to form both discharge vessel parts.

While embodiments of the present invention have been described in the foregoing specification and drawings, it is to be understood that the present invention is defined by the following claims when read in light of the specification and drawings.

What is claimed is:

1. A ceramic discharge vessel in a green state prior to assembly, comprising:

a first ceramic discharge vessel part in a green state;

a second ceramic discharge vessel part in a green state, said first and second discharge vessel parts being arranged and adapted to join together to form said discharge vessel;

a first removable handle temporarily and removably attached to said first discharge vessel part and that is arranged and adapted to maneuver said first discharge vessel part; and a second removable handle temporarily and removably attached to said second discharge vessel part and that is arranged and adapted to maneuver said second discharge vessel part, said first and second removable handles being solid shafts comprised of the same ceramic material as the ceramic discharge vessel parts.

2. The discharge vessel in a green state of claim 1, wherein said first and second removable handles are substantially collinear when said first and second discharge vessel parts are joined together.

3. The discharge vessel in a green state of claim 1, wherein said first discharge vessel part includes two capillaries that are next to each other and spaced from said first removable handle.

4. The discharge vessel in a green state of claim 3, wherein longitudinal axes of said two capillaries diverge from each other.

5. The discharge vessel in a green state of claim 3, wherein longitudinal axes of said two capillaries are parallel to each other.

6. The discharge vessel in a green state of claim 1, wherein said first discharge vessel part and said second discharge vessel part each includes one capillary, and wherein said two capillaries are next to each other and said first and second removable handles are substantially collinear when said first and second discharge vessel parts are joined together.

7. The discharge vessel in a green state of claim 6, wherein a combination of said first discharge vessel part, said first removable handle and a first one of the capillaries is identical to a combination of said second discharge vessel part, said second removable handle and a second one of the capillaries.

8. The discharge vessel in a green state of claim 6, wherein longitudinal axes of said two capillaries diverge from each other when said first and second discharge vessel parts are joined together.

9. The discharge vessel in a green state of claim 6, wherein longitudinal axes of said two capillaries are parallel to each other when said first and second discharge vessel parts are joined together.

10. The discharge vessel in a green state of claim 1, wherein said first discharge vessel part and said second discharge vessel part each are generally hemispheric.

11. The discharge vessel in a green state of claim 10, wherein said first and second removable handles are temporarily attached at respective poles of said first and second discharge vessel parts.

12. The discharge vessel in a green state of claim 1, wherein said first discharge vessel part and said second discharge vessel part each are identical to each other.

13. A ceramic discharge vessel in a green state prior to assembly, comprising:

a generally hemispheric first ceramic discharge vessel part in a green state;

a generally hemispheric second ceramic discharge vessel part in a green state, said first and second discharge vessel parts being arranged and adapted to join together to form said discharge vessel;

a first capillary attached to said first discharge vessel part and a second capillary attached to one of said first and second discharge vessel parts, said first and second capillaries being next to each other when said first and second discharge vessel parts are joined together;

a first removable handle temporarily and removably attached to a pole of said first discharge vessel part; and a second removable handle temporarily and removably attached to a pole of said second discharge vessel part, wherein said first and second removable handles are substantially collinear when said first and second discharge vessel parts are joined together, said first and second removable handles being solid shafts comprised of the same ceramic material as the ceramic discharge vessel parts.

14. The discharge vessel in a green state of claim 13, wherein said first capillary is attached to said first discharge vessel part and said second capillary is attached to said second discharge vessel part, and wherein a combination of said first discharge vessel part, said first removable handle and said first capillary is identical to a combination of said second discharge vessel part, said second removable handle and said second capillary.

* * * * *